US005086790A

United States Patent [19]

Greene, Jr.

[11] Patent Number: 5,086,790

[45] Date of Patent: Feb. 11, 1992

[54] METHOD OF AND APPARATUS FOR RECLAIMING CIGARETTES FROM CIGARETTE PACKAGES

[75] Inventor: Carl C. Greene, Jr., Winston-Salem, N.C.

[73] Assignee: R. J.Reynolds Tobacco Company, Winston-Salem, N.C.

[21] Appl. No.: 512,693

[22] Filed: Apr. 23, 1990

[51] Int. Cl.[5] ..... A24C 5/36

[52] U.S. Cl. ..... 131/96; 414/412; 414/418

[58] Field of Search ..... 131/96; 53/492, 381 R; 414/412, 404, 418; 221/31, 278; 83/931, 17, 14.7, 14.8

[56] References Cited

U.S. PATENT DOCUMENTS

| | | | |
|---|---|---|---|
| 3,026,880 | 3/1962 | Perrin | 131/96 |
| 3,103,222 | 9/1963 | DiIanni | 131/96 |
| 3,224,451 | 12/1965 | Dearsley | 131/20 |
| 3,266,541 | 8/1966 | Kluytenaar et al. | 414/412 X |
| 3,386,320 | 6/1968 | Pinkham et al. | 83/23 |
| 3,757,799 | 9/1973 | DiIanni et al. | 131/96 |
| 4,002,255 | 1/1977 | Fincham et al. | 214/305 |
| 4,036,380 | 7/1977 | Berry et al. . | |
| 4,083,499 | 4/1978 | Thatcher | 241/24 |
| 4,117,852 | 10/1978 | Newman et al. | 131/96 |
| 4,191,199 | 3/1980 | Sullivan | 131/96 |
| 4,221,035 | 9/1980 | Thatcher | 209/44.1 |
| 4,261,790 | 4/1981 | Brinker et al. | 156/584 |
| 4,278,100 | 7/1981 | Thatcher | 131/196 |
| 4,485,827 | 12/1984 | Komassa et al. | 131/84 |
| 4,622,875 | 11/1986 | Emery et al. | 83/80 |
| 4,843,801 | 7/1989 | Roncero | 53/492 |

FOREIGN PATENT DOCUMENTS

| | | |
|---|---|---|
| 0118289 | 9/1984 | European Pat. Off. . |
| 2158410A | 11/1985 | United Kingdom . |

*Primary Examiner*—V. Millino
*Assistant Examiner*—J. Doyle

[57] ABSTRACT

A method and apparatus for opening cigarette packs involving minimal contact with the cigarettes in the pack and little likelihood of damage or degradation of the tobacco contained in the cigarettes. The invention includes conveying packs to a first location where they are received, moving the packs to a second location where they are pressurized and expanded, moving the pressurized expanded packs to a third location where one end is cut off, moving the packs to a fourth location where impulse is applied to the pack as a whole, resulting in the transfer of the pack to a fifth location, where the motion of the pack itself is stopped, but the inertia of the cigarettes themselves is conserved sufficiently that they are transferred to a conveyance for further processing. The empty packs are disposed of at a sixth location. The method and apparatus is intermittent, involving regular starting and stopping motions. The device employed to expand the pack does not move transversely relative to the pack during the expansion process, thus limiting the likelihood of damage to the expansion device.

29 Claims, 7 Drawing Sheets

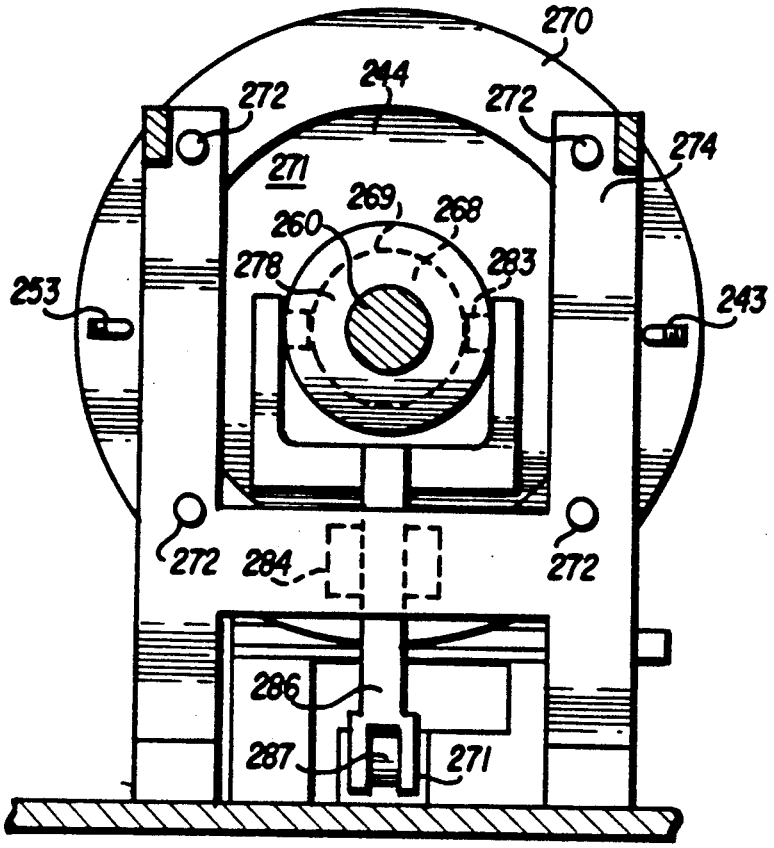
FIG. 5
FIG. 7
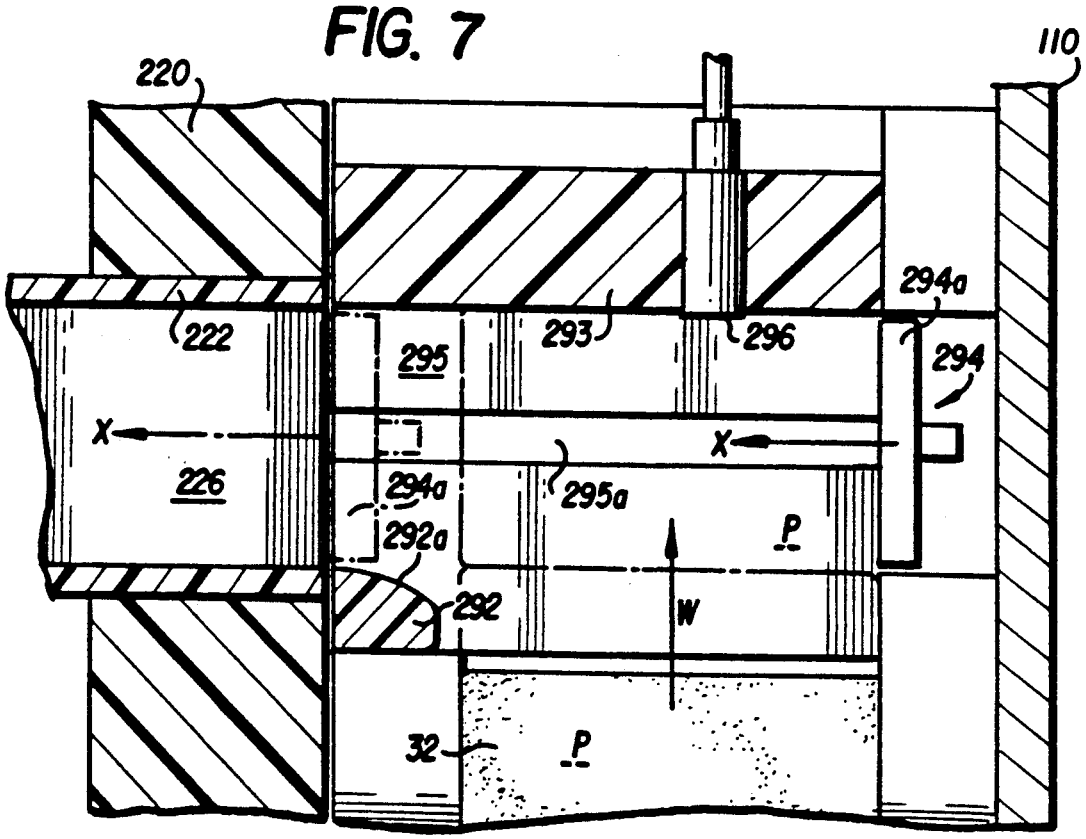

METHOD OF AND APPARATUS FOR RECLAIMING CIGARETTES FROM CIGARETTE PACKAGES

FIELD OF THE INVENTION

The present invention relates to smoking articles such as cigarettes, and more particularly, to a method of and an apparatus for removing cigarettes from packs to facilitate individual cigarette recovery and tobacco reclamation.

DESCRIPTION OF THE PRIOR ART

Cigarettes which may be recovered and reclaimed according to the present invention can vary in composition and construction. Typically, cigarettes comprise a rod of smokable material, such as a blend of shredded tobacco laminae, volume expanded shredded tobacco laminae, cut and processed tobacco stems, shredded reconstituted tobacco, and the like. The smokable material or cut filler is circumscribed by an outer wrapping material such as cigarette paper, e.g., a calcium carbonate and flax paper, thereby forming a tobacco rod. Tobacco rods typically have lengths of about 40 mm to about 85 mm, preferably about 55 mm to 70 mm, and circumferences of about 17 to about 27 mm, preferably about 22 mm to about 25 mm. For filter cigarettes, a filter element normally manufactured from plasticized cellulose acetate tow and circumscribed by a paper plug wrap is attached to one end of the tobacco rod. Filter elements can have flavors incorporated therein, contain charcoal, or the like. Filter elements typically have lengths of about 10 mm to about 40 mm, preferably about 15 to about 35 mm, and have circumferences comparable to that of the tobacco rod with which they are employed. A tipping paper typically circumscribes the filter element and an adjacent region of the tobacco rod so as to fixedly secure the filter element to the tobacco rod. Typical filter cigarettes are about 79 mm, about 84 mm and about 99 mm in length.

Cigarettes conventionally have been sold in packages called "packs," and each pack normally contains 20 cigarettes. The cigarettes are usually arranged in a matrix of three rows having 7 cigarettes, 6 cigarettes and 7 cigarettes, respectively. Typical cigarette packs have a generally rectangular parallelepiped form, having front and back panels, two side panels and two end panels. As used herein, the two end panels are the top and bottom of the pack. One type of popular cigarette pack employs a container having the form of a so-called "hard pack," "crush proof box" or "hinged lid package." Another type of popular cigarette pack employs a container having the form of the so-called "soft pack." Both types of cigarette pack typically are overwrapped by a clear polymeric film (e.g., a polyethylene or polypropylene overwrap film) to maintain freshness of the cigarettes within the container. A strip of polymeric material known as a "tear tape" is provided adjacent the top of the pack for easy opening of the polymeric overwrap film. Cigarette packs are packaged in cartons, typically ten packs per carton.

In order to maintain proper quality control during the manufacture and packaging process, defective packs or cartons are eliminated from the ultimate product stream, and separated for further reprocessing and reclamation of the tobacco therein. In addition, individual packs and cartons, which are otherwise acceptable, but which were part of field tests or promotional efforts which have expired or which have been completed, are returned for reclamation as well. Heretofore, in order to effect the removal of the tobacco from the packs and cartons, a significant amount of manual labor was involved. This included the opening of the individual cartons, then the opening of the individual packs and the removal of the cigarettes therefrom, and, finally, removal of the tobacco from the cigarettes. Alternatively, a hammermill was used to break up whole cartons and/or packs into a particulate mixture of tobacco, packaging material, filter elements and cigarette paper and the tobacco particles were then separated from the mixture. For example, U.S. Pat. No. 3,577,999, issued to Pinkham, is directed to a rotating vane device and sieve for separating tobacco from the filter and paper.

One apparatus for opening cigarette packs and extracting cigarettes therefrom includes a plurality of cigarette pack pockets mounted on a continuous chain drive system which intermittently moves the packs to various stations at which different operations are performed. The packs are inserted into the pack pockets each of which has a fixed length and the pack pockets are moved to and stopped momentarily at a location where a pair of needles are inserted into the bottom end panel of the pack, and air is injected through the needles to expand the pack. The needles are then withdrawn and the chain drive moves the pack pocket with the expanded, but only partially pressurized pack to a second location where a circular knife cuts off the top end panel. The pack pocket containing the pack with the open end is then moved to another location where it is aligned with a transfer wheel having a plurality of pack pockets mounted thereon. An air piston is used to push against the unopened pack end panel and the cigarette pack and contents are transferred by the impulse to the transfer wheel pocket. The transfer wheel pocket has a pair of fingers mounted so as to catch the lip of the pack, thereby stopping its motion relative to the cigarettes contained therein, which continue on to an outlet conveyor belt.

The apparatus referred to in the previous paragraph has the following features. First, the pockets are mounted on a chain drive, resulting in lost motion and imprecise alignment of the pockets due to wear. Second, the needles reciprocate transversely during the dwell periods between the cyclical advancing motion of the pack pockets, requiring adjustment of the dwell time and lost motion must be frequently made to prevent needle breakage. Third, the pack is not in communication with a source of air pressure at the time its end panel is cut off because the needles must be withdrawn from the pack before the expanded pack is advanced to the end panel removal location, and thus maintenance of full expansion cannot be assured. Fourth, in order to accommodate packs of different lengths, a rub bar interfacing with the back of each pack pocket must be manually adjusted. This results in a gap between the end of the pack pocket and the rub bar when the prior art apparatus is adjusted to accommodate all but the shortest packs. Finally, because of the orientation of the packs on their faces rather than sides when they are blown out of the pack pockets, there is greater sliding surface area and hence greater friction, resulting in greater air jet requirements. The present invention overcomes these difficulties.

Various other efforts have been undertaken to automate the tobacco reclamation process. Examples of efforts directed to removing cigarettes from cigarette packs include the following patent documents: U.S. Pat. No. 4,843,801, issued to Roncero; U.S. Pat. No. 4,083,499, issued to Thatcher; U.S. Pat. No. 4,221,035, issued to Thatcher; European Patent Publication No. 0118289; U.K. Patent Application No. GB2158410A; U.S. Pat. No. 3,386,320, issued to Pinkham et al.; U.S. Pat. No. 4,622,875, issued to Emery et al.; and U.S. Pat. No. 4,002,255, issued to Fincham et al.

In addition to patents directed to the removal of cigarettes and tobacco from intact packages, efforts have also been directed toward removal of tobacco from individual cigarettes as well. Examples of such efforts include: U.S. Pat. No. 4,261,790, issued to Brinker et al.; U.S. Pat. No. 4,278,100, issued to Thatcher; U.S. Pat. No. 4,117,852, issued to Newman et al.; U.S. Pat. No. 3,103,222, issued to DiIanni; U.S. Pat. No. 4,191,199; U.S. Pat. No. 3,757,799, issued to DiIanni et al.; U.S. Pat. No. 3,026,880, issued to Perrin; U.S. Pat. No. 3,224,451, issued to Dearsley; and U.S. Pat. No. 4,485,827, issued to Komassa et al.

Many of the prior art methods and apparatus for tobacco reclamation involve intrusive, destructive means and methods for performing the separation of cigarettes from packaging materials. Such means and methods often resulted in degradation of the tobacco itself, either by reducing the size of the tobacco fiber strands, or in drying out the tobacco. Additionally, the option of recovering intact and otherwise acceptable individual cigarettes is limited in those processes which separate cigarettes from packs by means of devices which interact simultaneously with the cigarettes and packaging materials as, for example, by beating the packs with a hammermill or by slicing the packs and cigarettes. Furthermore, because in many of the abovementioned prior art methods and devices, the packaging, cigarette paper and filter material are each being subjected to the same separation forces as the tobacco, there is an increased likelihood that the tobacco will suffer some contamination by the non-tobacco parts, i.e., the paper, foil, etc. of the packaging or the tow, charcoal, flavorant, etc. of the filter.

As a result of the deficiencies in prior tobacco reclamation efforts, it is desirable to provide a method and apparatus which includes the steps of and means for opening cigarette packs and removing cigarettes from the packs to facilitate individual cigarette recovery. Such desirable method and apparatus should accomplish this result while minimizing the degradation of the recovered cigarettes, which will thus improve the quality of the reclaimed tobacco which is ultimately extracted therefrom.

SUMMARY OF THE INVENTION

The present invention is directed to a method of and apparatus for tobacco recovery and reclamation including a minimally intrusive method of and apparatus for removing individual cigarettes from cigarette packs. The present invention can be used (1) to reclaim cigarettes intact, or (2) for subsequent processing to reclaim the tobacco therein, and (3) for reducing or eliminating of paper and filter contamination of reclaimed tobacco. In addition, packs for different lengths of cigarettes can be processed. The process of the present invention reduces the likelihood of damage to or degradation of the reclaimed tobacco filler thereby yielding reclaimed tobacco of high quality.

The method and apparatus for opening cigarette packs according to the present invention involves minimal contact with the packaged cigarettes and hence, reduces the likelihood of damage or degradation of the tobacco contained in the cigarettes. The method of the invention includes the steps of conveying packs to a first location where they are received, moving the packs to a second location where they are pressurized and expanded, moving the pressurized expanded packs to a third location where one end is cut off, moving the packs to a fourth location where the pack is accelerated to a velocity by the application of a force, resulting in the transfer of the pack to a fifth location, where the motion of the pack itself is stopped, but the momentum of the cigarettes in the pack is sufficient to propel them out of the pack and to a conveyance means for further processing. Disposal of the empty packs occurs at a sixth location. The components of the apparatus move intermittently, involving regular starting and stopping motions. The device employed to expand the pack does not move relative to the pack during the pack expansion and end panel cut off process, thus minimizing the likelihood of damage to the expansion device.

In a preferred embodiment of the apparatus of the invention, a tray or hopper of cigarette packs is mounted so that rows of cigarette packs to be opened are fed by a reciprocating plate onto a conveyor belt. The packs are then conveyed to a pack guide and rake which transfers each pack individually to a pocket in a drum assembly. In the disclosed embodiment, the drum assembly has four operating positions. At a first position, a pack is received in one of a plurality of pockets. Each pocket has one or more needles positioned to puncture a cigarette pack end panel, preferably at an interstitial position in the cigarette matrix so as not to occlude the needle passage. The needle communicates with an air supply slot which, beginning at the second operating position and continuing on to the third operating position, supplies air to the needles to pressurize the pack. Between the second and third positions, the end panel of the expanded and pressurized pack is cut off, preferably by a rotary circular knife. The pocket then moves to the fourth operating position, where the pocket communicates with an air supply which applies a pneumatic force to the unopened end panel of the pack thereby accelerating the pack along its axis. The pack and the cigarettes contained therein are thus transferred from the drum pocket to a fifth position which is preferably a pocket in a rotary transfer wheel, aligned with the drum pocket in the fourth operating position. The pocket in the transfer wheel is open at both ends, but is equipped with one or more fingers to grasp and stop the motion of the packaging material. The continued motion of the cigarettes relative to the stopped packaging material results in separation of the cigarettes from the packaging material. The cigarettes are then conveyed on for further processing. The empty package is moved in the transfer wheel to a sixth position where it is blown out of the transfer pocket by an air blast for disposal.

With the foregoing and other advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 5 is a partial end elevation view of the pack opener drum assembly taken through the section E—E (FIG. 2);

FIG. 7 is a fragmentary cross-sectional view through section C—C of FIG. 4 showing the pack rake and inlet guide;

DETAILED DESCRIPTION OF THE INVENTION

Figure 1:
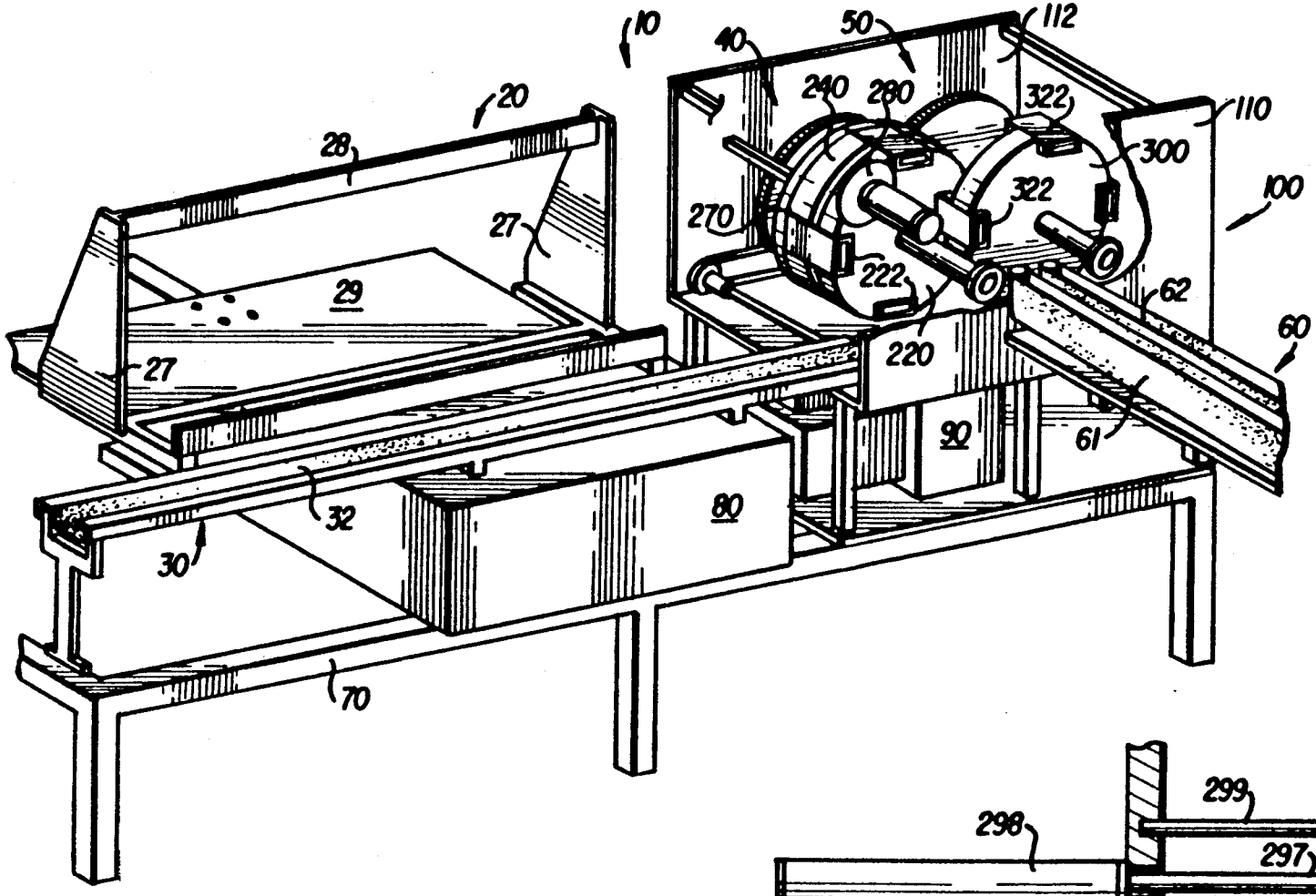
FIG. 1 is a perspective view of the pack opener apparatus of the present invention.
Figure 2:
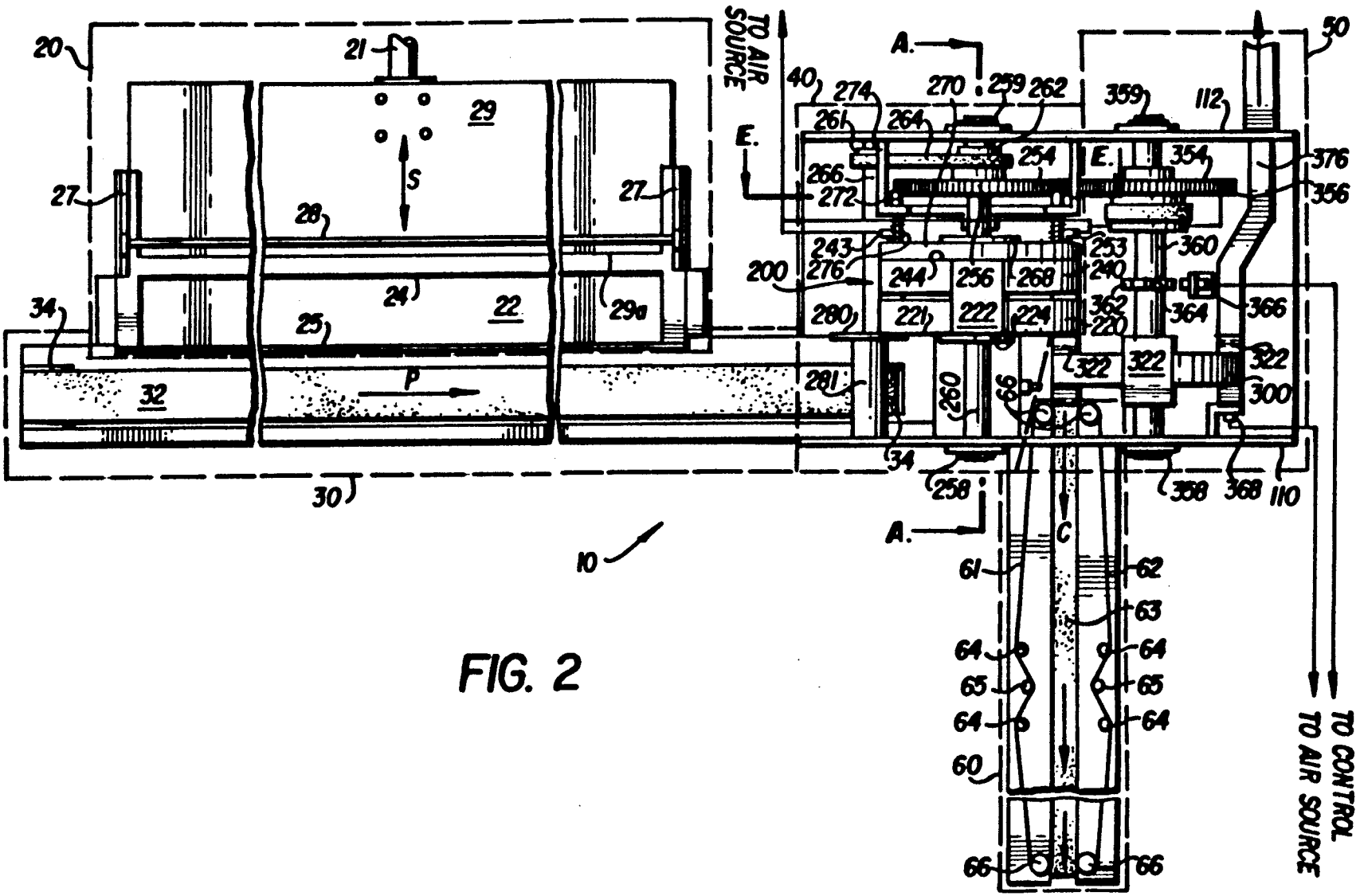
FIG. 2 is a top plan view of the pack opener apparatus of the invention.

Referring now in detail to the drawings wherein like parts are designated by like reference numerals throughout, there is illustrated in FIG. 1 a perspective view of a cigarette pack opening apparatus embodying the invention, designated generally by the numeral 10. FIG. 2 illustrates in a top plan view a more detailed view of a preferred embodiment.

The cigarette pack opening apparatus 10 is comprised of five major subassemblies, a pack tray holder 20, a pack inlet belt assembly 30, a cigarette pack opener assembly 40, a cigarette extraction assembly 50, and a cigarette outlet belt assembly 60. Associated with the major subassemblies, as shown in FIG. 1, are a stand 70, control and power means 80 and 90 and support structure 100 for the cigarette pack opener assembly 40 and the cigarette extraction assembly 50. FIG. 2 provides a more detailed view of aspects of each subassembly.

As shown in FIGS. 1 and 2, pack tray holder 20 is mounted so as to enable rows of cigarette packs (not shown) from a cigarette tray (also not shown, but of the type 82-86 mm available from Sasib as part no. P930203005F) to be fed transversely onto pack inlet belt assembly 30. From there the cigarette packs are fed to cigarette pack opener assembly 40, which opens the packs, and, in cooperation with cigarette extraction assembly 50, removes the cigarettes from the packs. The removed individual cigarettes are carried away from cigarette extraction assembly 50 by outlet belt assembly 60. The operation and cooperation of each of the subassemblies is described below.

The cigarette pack tray holder 20 is arranged relative to pack inlet belt assembly 30 so that cigarette packs can be fed one row at a time from the cigarette tray (not shown) with the longitudinal axes of the cigarette packs transverse to pack inlet belt 32. A cigarette pack tray is fitted in tray holder receiver space 22 abutting tray supports 24 and 25 and is further supported by tray holder side panels 27 and cross member 28.

Pack slide 29 is operated by the reciprocation in the directions of arrow S of the piston rod (not shown) of a pneumatic cylinder 21 which causes the forward edge 29*a* of pack slide 29 to engage the bottommost row of cigarette packs held in the cigarette tray. Thus, one row of cigarette packs is delivered to inlet belt 32 when the piston rod of cylinder 21 is extended in the direction of pack inlet belt assembly 30. Pack inlet belt 32 is an endless conveyor belt trained about pack inlet belt pulleys 34. A row of cigarette packs from the cigarette tray is conveyed along pack inlet belt 32 until the first pack of the row reaches a pack inlet guide 292 and rake 294 assembly (FIGS. 4, 7 and 8), discussed hereinafter, which inserts individual packs into the cigarette pack opener assembly 40.

Cigarette pack opener assembly 40 is an indexed, intermittently operated assembly which works in synchronization with cigarette extraction assembly 50. Cigarette pack opener assembly 40 receives individual cigarette packs from an inlet stream of packs, expands each pack, removes an end panel therefrom, and applies an acceleration force to the opened packs to impart a velocity to the opened packs and their contents, thereby transferring the opened packs to the cigarette extraction assembly 50 which extracts the cigarettes from the pack. The extracted cigarettes are then transported away from the cigarette extraction assembly 50 by outlet belt assembly 60 for further processing. The empty packs are transported by cigarette extraction assembly 50 to a different location for disposal.

Outlet belt assembly 60 is comprised of two parallel endless conveyor belts 61 and 62 which form the walls of a vertical moving channel, and a horizontal endless conveyor belt 63 which forms the bottom of the moving channel. Belts 61 and 62 are trained about pulleys 64 and 66 and belt tensioners 65 and belt 63 is also trained about pulleys and tensioners (not shown).

FIGS. 2-5 and 9 show the elements and cooperation of the cigarette pack opener assembly 40 and the cigarette extraction assembly 50. Cigarette pack opener assembly 40 is comprised of a cigarette pack expansion and opener drum assembly 200, and associated equipment described below. Cigarette extraction assembly 50 includes a transfer wheel 300 and associated equipment described hereinafter.

The drum assembly 200 comprises three main components, a pair of interlocking rotatable drum wheels 220 and 240 coaxially mounted on a drum shaft 260 and a non-rotatable ring 270. Drum wheels 220 and 240 and ring 270 can each be made from a suitable structural plastic, such as a polyamide or nylon. Other materials, including lightweight metals are also contemplated. Drum shaft 260 is rotatably mounted in bearings 258, 259 in front and rear plates 110, 112, respectively of support structure 100. A pulley 262 on drum shaft 260 is engaged by a drive belt 264 which is intermittently driven by a drive motor (not shown) via a drive shaft 266. A plurality of cigarette pack pockets 222 are mounted at equi-angular intervals around the periphery of drum wheel 220 and slidably engage in cutouts 242 (FIG. 3) in drum wheel 240. A circular knife 280, driven by motor 281 is mounted abutting the face 221 of drum wheel 220 and substantially coplanar with the open front ends 224 of pack pockets 222 for a purpose to be hereinafter described.

Figure 3:
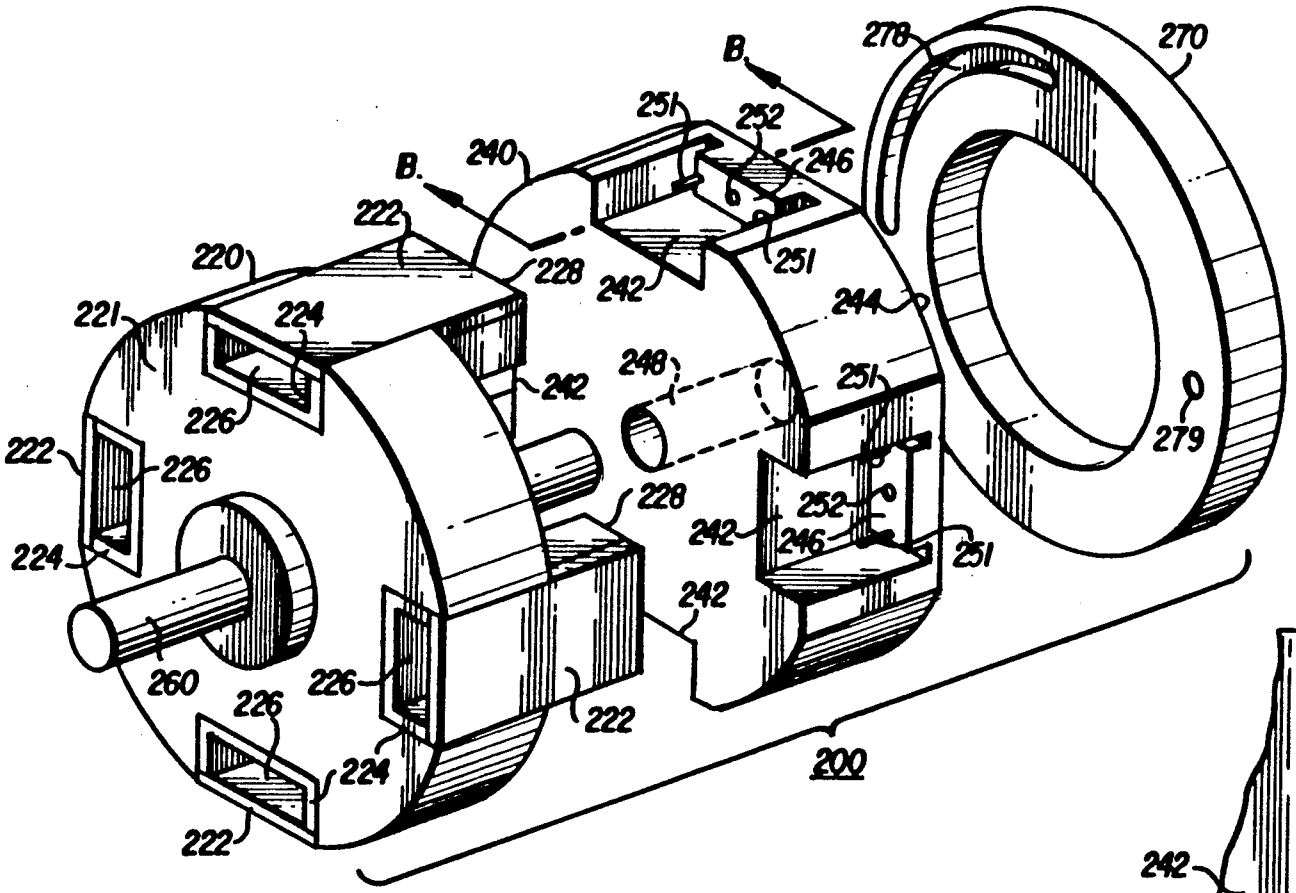
FIG. 3 is an exploded perspective view of a pack opener drum assembly.

FIG. 3 shows the assembly and cooperation of opener drum wheels 220 and 240 and non-rotatable ring 270 in an exploded perspective view of the drum assembly 200. As shown, opener drum wheel 220 is provided with four cigarette pack pockets 222 spaced at equiangular intervals of 90°. Each cigarette pack pocket 222 has a cavity 226 and open rear end 228. Opener drum wheel 240 has a plurality of matching wheel cutouts 242 which slidably engage with the rearwardly projecting ends 228 of pack pockets 222. Each cutout 242 has a projecting block 246 which substantially sealingly engages in a respective cavity 226, thereby forming slidable end closures for the open rear ends of the pockets 222. The slidable relation between the blocks 246 and the cavities 226 permits the depth or length of the cavity 226 to be adjusted for cigarette packs of various lengths. Each opener drum wheel cutout 242 is fitted with one or more needles 251 and air holes 252.

Opener drum wheel 220 is rigidly mounted to drum shaft 260 and opener drum wheel 240 has a central bore 248 slidably mounted on drum shaft 260. Non-rotatable ring 270, having an arcuate air slot 278 and an ejection air hole 279, is arranged to abut and be pressed against the rear face 244 of opener drum wheel 240.

Figure 4:
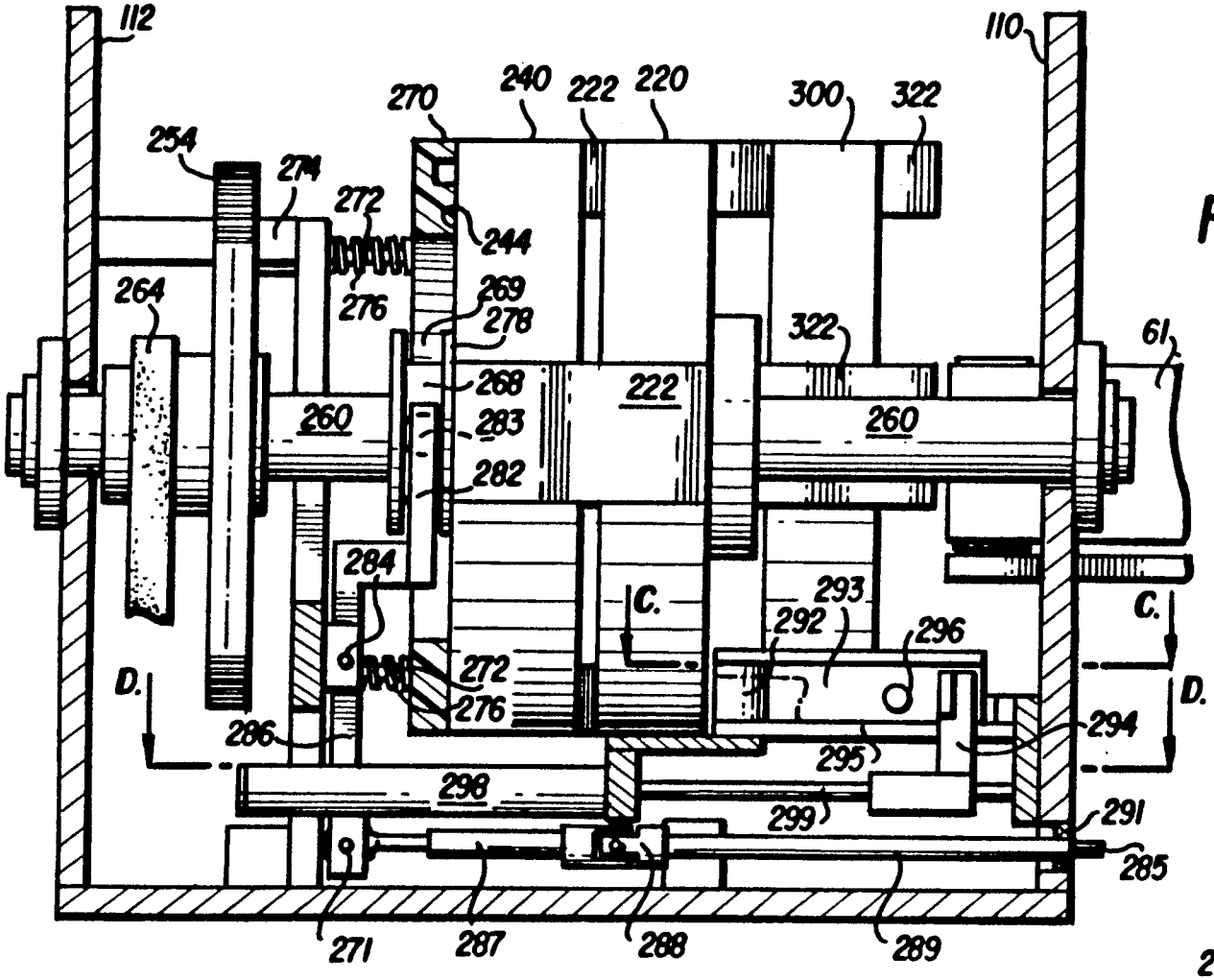
FIG. 4 is a side elevation view of the pack opener apparatus taken in partial section through section A—A of FIG. 2.

FIGS. 4 and 5 illustrate the pack length adjustment and cooperation between the components of the drum assembly 200. As described above, non-rotatable ring 270 abuts the rear surface 244 of opener drum wheel 240. A hub 268 slidably mounted on drum shaft 260 is attached to the rear surface 244 of opener drum wheel 240, and thus is rotatable and slidable therewith. A yoke 282 has roller bearings 283 which reside in an annular groove 269 provided in hub 268 and is pivotally mounted at a fixed pivot pin 284. Yoke 282 includes a lever arm 286 pivotally attached by pivot pin 271 to a turnbuckle mechanism 287 which is, in turn, connected through a universal joint 288 to a drive rod 289. Rod 289 is rotatably mounted in a bearing 291 fixed in front plate 110 and is provided at its free end with a wrench drive connection 285. Using a wrench (not shown) to rotate rod 289, the length of turnbuckle 287 can be adjusted resulting in the pivoting of yoke 282 about fixed pivot pin 284, thereby altering the spacing between opener drum wheels 220 and 240. This results in an increase or decrease in the longitudinal dimension or depth of cavities 226 (FIG. 3) of the pack pockets 222 thereby allowing the drum assembly 200 to accommodate different sized packs. Non-rotatable ring 270 is slidably mounted by pins 272 to bracket assembly 274, with springs 276 biasing the ring 270 against the rear face 244 of drum wheel 240. Thus, when the two drum wheels 220, 240 are moved relative to one another to accommodate different size cigarette packs, the ring 270 remains pressed in substantial sealing contact against the rear surface 244 of drum wheel 240, thereby providing a sufficient seal for air to be communicated to needle assembly 240 via an air inlet 243 on ring 270, as described below.

Figure 6:
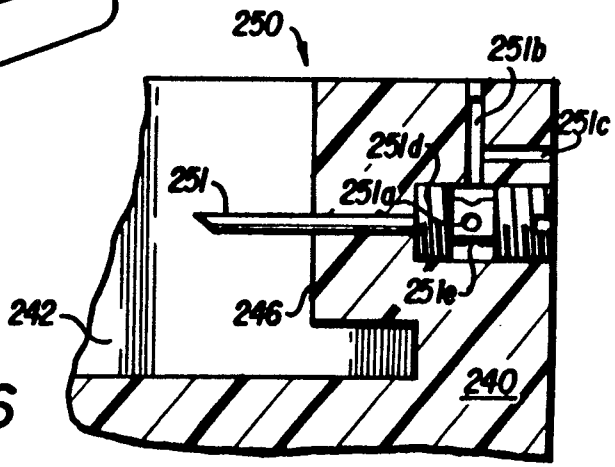
FIG. 6 is a fragmentary cross-sectional view taken through section B—B of FIG. 3 showing a needle assembly fitted to a cigarette pack pocket of the drum assembly.

FIG. 6 illustrates a pack expansion needle assembly 250 taken through section B—B of FIG. 3. Needle 251 is fitted to a threaded plug **251*d* having air inlet holes 251*a* and an annular groove 251*e*. Annular groove 251*e* communicates with air inlet 251*c* through passage 251*b*. Needle assembly 250 is mounted in block 246 of pack opener wheel 240 and communicates with pocket cavity 226 when an associated pack pocket 222 is mated with block 246. Preferably, a pair of needles 251** are provided, spaced apart and aligned so as to pierce the end panel of a cigarette pack and longitudinally penetrate the pack at an interstitial position in the cigarette matrix.

Figure 11:
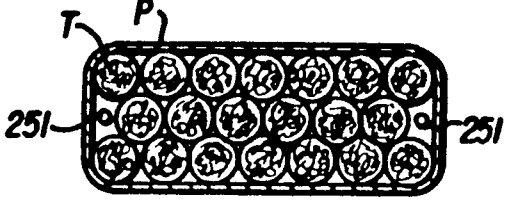
FIG. 11 is a transverse cross-sectional view of a cigarette pack showing a representative 7-6-7 cigarette matrix.

FIG. 11 shows a cross-sectional view of a cigarette pack P taken transversely to the longitudinal axis of the cigarettes T. The cigarette matrix shown is 7-6-7. Needles 251 are shown inserted in the longitudinal spaces at the ends of the row having six cigarettes. In the case of other cigarette matrices, the needles are positioned to be inserted at the appropriate interstitial positions or empty spaces in the matrices.

Figure 8:
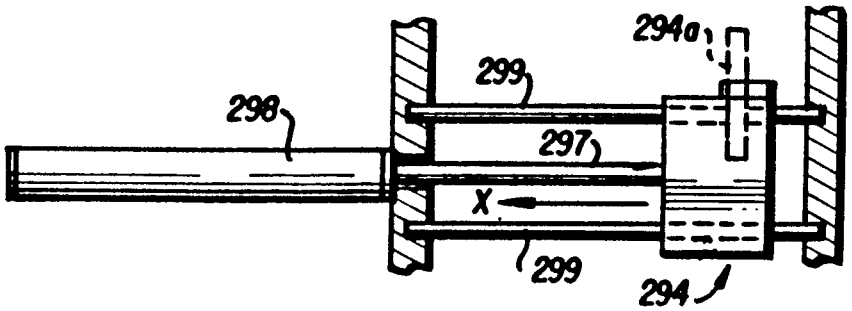
FIG. 8 is a fragmentary cross-sectional view through section D—D of FIG. 4 of the pack rake.

FIGS. 4, 7 and 8 illustrate the operation of the pack inlet guide 292 and inlet rake 294. Packs P are moved along the pack inlet belt 32 in the direction shown by arrow W until the leading or downstream pack abuts a stop wall 293. Stop wall 293 halts the pack P from travel in the direction of arrow W and cooperates with inlet guide 292, which is formed having a convergent convex surface **292*a* which serves to funnel pack P toward cigarette pack expansion and opener drum pocket cavity 226. Stop wall 293 and pack inlet guide 292 can be formed integrally with a cavity therein to accept a cigarette pack P or they can be formed separately. The presence of a pack P at stop wall 293 is detected by a proximity switch 296 (such as a model no. NJ2-12GM40-A-Y16746, manufactured by PepperL and Fuchs, Inc.), which actuates a cylinder 298 with a reciprocatable piston rod 297 attached to inlet rake 294 which causes the leading pack P to be moved past pack inlet guide 292 and into cigarette pack expansion and opener drum pocket cavity 226 in the direction indicated by arrow X. Rake 294 includes a rake head 294*a* slidably mounted on a pair of guides 299. Rake head 294*a* extends through a slot 295*a* in a slide plate 295, aligned to have substantially the same elevation as the bottom of cavity 226 and the upper run of conveyor belt 32. When cylinder 298 is actuated by proximity switch 296, the rod 297 moves the rake head 294*a* along guides 299, as shown by arrow X, to the position shown in phantom lines in FIG. 7, thereby pushing a pack P into the cavity 226 of a pack pocket 222. The cylinder 298 then returns the piston rod 297 and rake head 294*a* to its position for engaging the next pack P conveyed onto plate 295**.

Figure 9:
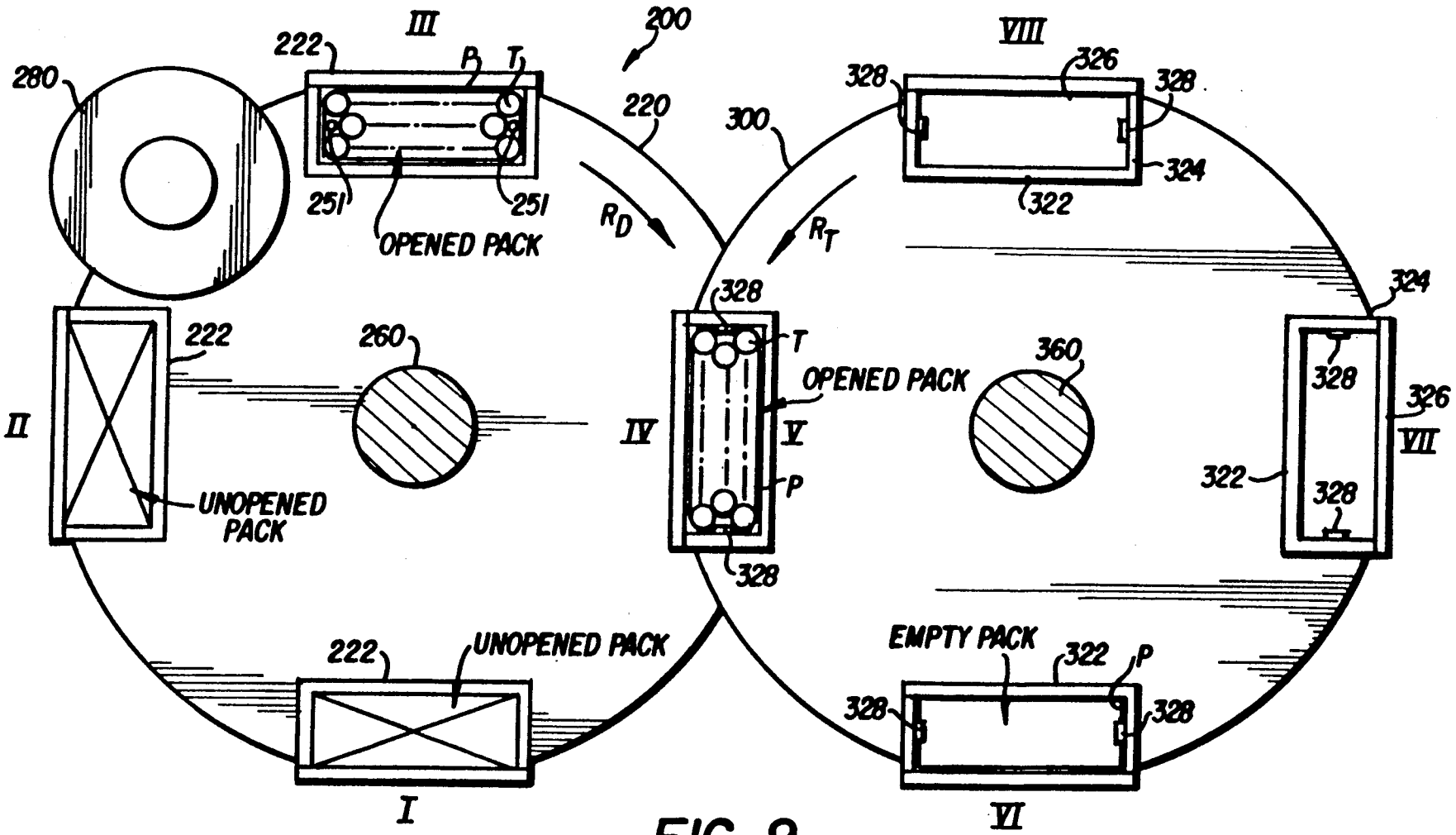
FIG. 9 is a front elevational view of the transfer wheel and drum assembly.
Figures 10A, 10B:
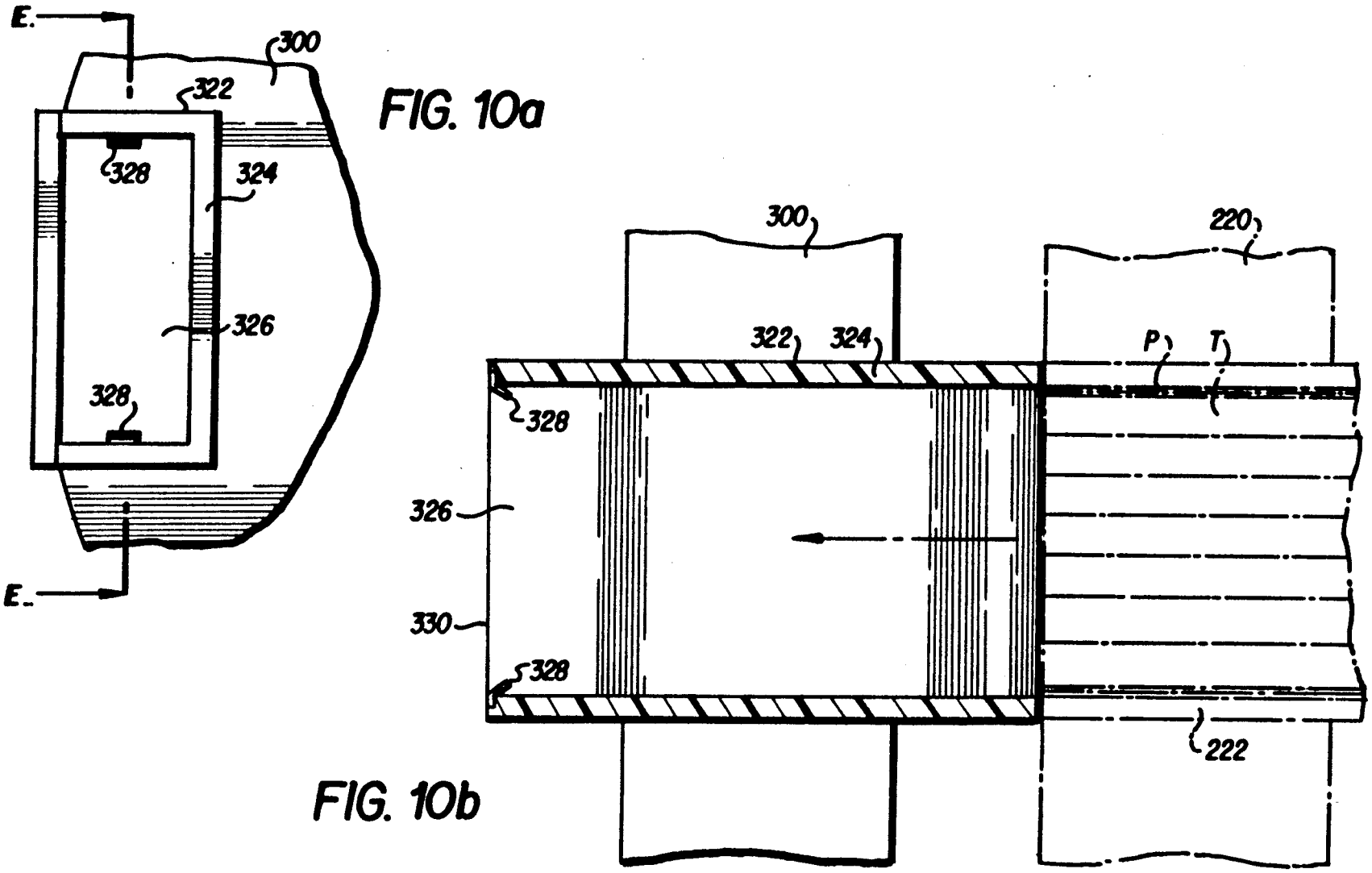
FIG. 10*a* is a front elevational view of the transfer wheel pocket.
FIG. 10*b* is a cross-sectional view through section E—E of FIG. 10*a* showing the fingers in a transfer wheel pocket.

The cigarette extraction assembly 50 is shown in FIGS. 2, 9, **10*a* and 10*b*. The major component of the cigarette extraction assembly 50 is the transfer wheel 300 (which is preferably made from similar materials to those in the drum assembly 200). FIGS. 10*a* and 10*b* illustrate a transfer wheel pack pocket 322, mounted on a transfer wheel 300. The transfer wheel pack pocket 322 has walls 324 which define an essentially rectangular open-ended cavity 326. Fingers 328 are mounted on the inside of the cavity 326 near the front end 330 of the pocket. Cigarette packs are received at a rear end 332 of the pack pocket 322. FIG. 9 shows the alignment of the transfer wheel 300 with the drum assembly 200. As shown, transfer wheel 300 also has four pack pockets 322 spaced at equal angles, similar to the drum assembly 200 pack pockets 222. The drum assembly 200 and transfer wheel 300** are counterrotating as shown by arrows and $R_D$ and $R_T$, respectively.

Referring to FIG. 2, synchronization of the cigarette pack opener assembly 40 and cigarette extraction assembly 50 is accomplished as follows: A drum gear 254 is mounted on drum shaft 260 and a transfer wheel gear 354 is mounted on a transfer wheel shaft 360. Transfer wheel shaft 360 is mounted in bearings 358, 359 fixed to front and rear plates 110, 112, respectively. Drum gear 254 and transfer wheel gear 354 cooperate through intermeshing teeth 256, 356, respectively, to ensure synchronous motion between the drum assembly 200 and the transfer wheel 300. A drive means (not shown) connected through shaft 266 and gear 261, belt 264 and gear 262 intermittently drives drum shaft 260 in 90° increments. Transfer wheel 300 is driven through the intermeshing gears 254 and 354. Transfer wheel shaft 360 has a wheel position indicator 362 mounted on it. Wheel position indicator 362 is comprised of a plurality of projections 364 which indicate the position of transfer wheel 300 and drum assembly 200. Sensor 366, which may be a proximity switch similar to proximity switch 296, detects the passage of the wheel position indicator projections 364 and regulates the flow of air to the various air passages described herein.

The assemblies described above cooperate to receive a cigarette pack, expand the cigarette pack, cut off an end panel of the pack, apply an acceleration force to the cigarette pack, place the pack and contained cigarettes in motion, and stop the pack material, but not the contained cigarettes thereby separating the cigarettes from the pack. FIG. 9 shows the sequence of the processing of cigarette packs by the method and apparatus of the invention. At a location designated I at the bottom of drum 220, an intact, unopened pack is shown inserted in a pack pocket 222. At location II, another unopened pack is located in another pack pocket 222. At location III, an open pack is shown with an end panel cut off. At overlapping locations IV and V, an open pack is shown in transfer wheel pack pocket 322, with the packaging material gripped by fingers 328. At location VI, an empty pack is shown with the packaging material remaining in the pack pocket 322. At locations VII and VIII, the packaging material has been removed and the transfer wheel pack pockets 322 are ready to receive another opened pack once they are rotated into position at location V.

The manner of accomplishing the method of the invention will now be described. As previously mentioned, a stream of cigarette packs is fed along pack inlet belt 32. Upon arriving at pack inlet guide 292 and stop wall 293 (FIGS. 4, 7, and 8) and being detected by proximity switch 296, an individual pack P is pulled by pack inlet rake 294 into pack pocket 222 of the drum assembly 200, when the pack pocket 222 is located in position I (FIG. 9) at the bottom of the cigarette pack expansion and opener drum assembly 200. When a cigarette pack is received in cigarette pack pocket 222 at position I, preferably two needles 251 puncture the pack at appropriate interstitial positions in the cigarette matrix (FIG. 11). The pack expansion and opener drum assembly 200 with its attached pack pocket 222 is then rotated, 90° as shown in the figures, to position II of FIG. 9 until needle air inlet holes 251c (FIG. 6) communicate with arcuate air slot 278 in non-rotatable ring 270 (FIG. 3). A source of pressurized air is provided to air slot 278 through air inlet 243 (FIG. 5). As interlocked opener drum wheels 220 and 240 rotate through the approximately 90° arc of air slot 278, the cigarette pack is expanded against the inside walls of pocket 222 and block 246. The unconfined end of the pack at the face 221 of the drum 220 is distended outwardly. As the drum assembly 200 rotates 90° from position II to position III, rotary circular knife 280 cuts off the distended end of the expanded pack. Thus, the cutting action occurs while the pack is still subject to expansion air pressure and remains fully expanded. The cut off end panel is drawn away from the drum assembly by a vacuum duct (not shown).

From position III, the drum assembly 200 is rotated through another 90° angular interval to position IV, until the air hole 252 in the pack pocket block 246 is aligned with air hole 279 in non-rotatable ring 270 (FIG. 3). At this point, because of the synchronized motion of drum assembly 200 and transfer wheel 300, pack pocket 222 is aligned with a pack pocket 322 of the transfer wheel. In response to a signal from proximity sensor 366 which is activated by a projection 364 on position indicator 362, air is admitted to air inlet 253 (FIG. 5) passes through air holes 279 and 252 and impinges on the closed end of the cigarette pack thereby imparting a velocity to the entire pack and the cigarettes contained therein along the pack axis. The air thus forces the open pack out of cigarette pack pocket 222 and into pack pocket 322 of transfer wheel 300 at overlapping positions IV and V. Two small fingers 328, mounted in pack pocket 322, catch the edges of the cigarette pack and stop the travel of the package material, but permit the cigarettes contained therein to continue at a sufficient velocity to carry the cigarettes free of the pack and into the channel formed by outlet belts 61, 62 and 63 of outlet belt assembly 60. The transfer wheel 300 is then rotated 90° to position VI where the front end 330 of pack pocket 322 communicates with an air inlet (not shown) which, in response to a signal from proximity sensor 366, blows the empty pack into a vacuum duct 376 for disposal. A redundant or backup air inlet 368 and vacuum duct 376 may be provided at position VII to insure that the packaging material has been removed.

FIGS. 1-11, described above, depict apparatus which performs a method of opening cigarette packs and removing the cigarettes from them. The method of the apparatus includes conveying cigarette packs to a first location, where they are received, moving the packs to a second location where the packs are each expanded by a device which engages the packs such that the device used for such engagement does not move transversely to the cigarette pack. The expanded and pressurized pack is moved to a third location at which an end panel is cut off. The pack with one end panel removed is then moved to a fourth location where an accelerating force is applied to the pack as a whole, imparting a velocity to the pack and its contents, resulting in the transfer of the pack to a fifth location, where the motion of the pack itself is stopped, but the motion of the cigarettes is conserved sufficiently that they are transferred to a conveyance for further processing. The empty packs are moved to a sixth location where they are ejected and discarded.

As explained above, the present invention has a number of advantages. Among them are the reduced likelihood that individual cigarettes will be damaged when the distended end of the expanded pack is removed. Furthermore, since the cigarettes are reclaimed intact, degradation of the tobacco contained in the individual cigarettes is also significantly reduced. In addition, the cooperation of the assembly which moves the individual packs during the expansion, opening, impulse and extraction phases, results in the expansion needles remaining immovable relative to the pack which is the workpiece. This diminishes the likelihood that the needles will break off as occurred occasionally in the prior art assembly. Because the packs remain fully expanded at the time an end panel is cut off, there is less likelihood that the cigarette or filter ends will be damaged by the cutting knife. The present device is also adjustable to accommodate various size packs, while maintaining a seal at the rear end of the pack pocket. Finally, because no chain drive is used, lost motion and misalignment are reduced.

While pack pockets and wheel transfer pockets arranged at 90° interval and therefore numbering four are illustrated, other angular interval arrangements are contemplated with an attendant change in the number of pockets. The gearing of the drum assembly and transfer wheel may permit their counter-rotation, or their rotation in the same direction.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for opening cigarette packs and removing the cigarettes therefrom, each of said packs having two side panels, a front and back panel and two end panels, the apparatus comprising:

(a) means for receiving the cigarette pack;

(b) means for penetrating the cigarette pack, said penetrating means engaging the cigarette pack so as to be fixedly attached to said receiving means;

(c) means, communicating with said penetrating means, for expanding the cigarette pack;

(d) means for cutting of a cigarette pack end panel, thereby exposing a pack edge;

(e) means for imparting motion to the cigarette pack and cigarettes contained therein; and (f) means for stopping the moving cigarette pack, to separate the cigarettes from the pack.

2. Apparatus as in claim 1, wherein said cigarette pack penetrating means comprises at least one needle, inserted through an end panel, essentially parallel to the longitudinal axis of the pack and in an interstitial space between the cigarettes, said at least one needle communicating with an air supply.

3. Apparatus as in claim 1, wherein said cigarette pack receiving means is adjustable to accommodate cigarette packs of different lengths.

4. Apparatus as in claim 1, wherein said means for cutting off a cigarette pack end panel comprises a rotatable circular knife mounted to contact the expanded pack.

5. Apparatus as in claim 1, wherein said motion imparting means comprises an air supply means directed at the end panel of the pack opposite the cut off end panel.

6. Apparatus as in claim 1, wherein said pack stopping means comprises one or more stationary fingers mounted so as to grip the edge of the open cigarette pack.

7. Apparatus for opening cigarette packs and removing cigarettes therefrom, said packs having a pair of end panels and containing cigarettes arranged in a matrix, the apparatus comprising:

(a) drum means having a plurality of first pockets for receiving cigarette packs;

(b) means for inserting the packs into said first pockets;

(c) means, disposed in each first pocket, for penetrating one end panel of the cigarette pack inserted therein;

(d) means, communicating with said penetrating means, for expanding the end panel opposite the penetrated end panel;

(e) means for cutting off said one expanded end panel to open one end of each pack;

(f) means for ejecting the packs having an open end and the cigarettes contained therein from the first pockets of the drum means;

(g) transfer wheel means having a plurality of second pockets and arranged adjacent the drum means for receiving the open packs ejected from the drum means; and (h) means mounted on said second pockets for stopping the open packs in said second pockets and for permitting the cigarettes to separate from the packs at the open ends thereof.

8. Apparatus as in clam 7, wherein said means for penetrating the cigarette pack end panel comprises at least one needle positioned in each first pocket so as to pierce the one end panel at an interstitial position in the cigarette matrix.

9. Apparatus as in claim 7, wherein said first pockets are adjustable in length to accommodate cigarette packs of different lengths.

10. Apparatus as in claim 8, including means for rotating said drum means, said expanding means including a first air supply communicating with said at least one needle over an arcuate path of travel of said drum means.

11. Apparatus as in claim 10, wherein said cutting means comprises a rotary knife means mounted adjacent said drum means for cutting off said end panel opposite the penetrated end panel as said drum means is rotated past said knife means through said arcuate path.

12. Apparatus as in claim 7, wherein said ejecting means comprises second air supply means communicating through a hole in said first pocket with the penetrated end panel of the cigarette pack.

13. Apparatus as in claim 7, wherein said means for stopping the cigarette pack comprises one or more fingers mounted in the sides of each of said transfer wheel second pockets.

14. A method for opening a cigarette pack and removing the cigarettes therefrom, the packs having two side panels, a front and back panel and two end panels, comprising the steps of:

(a) receiving the cigarette pack in a pack pocket means;

(b) penetrating the cigarette pack at one end panel with a pack penetrating device, the pack penetrating device being fixedly attached to the pack pocket means;

(c) expanding the cigarette pack with a pack expansion device communicating with said penetrating device;

(d) cutting off the end panel opposite the penetrated panel;

(e) accelerating the cigarette pack and cigarettes contained therein to move the cigarettes and pack in the same direction; and (f) stopping the cigarette pack, thereby separating the cigarettes from the pack.

15. Apparatus for opening a cigarette pack and removing the cigarettes therefrom, said pack having two side panels, front and back panels, and two end panels enclosing a space for the cigarettes comprising:

(a) pocket means for receiving the cigarette pack at a first position;

(b) means for moving said pocket means to second and third positions;

(c) means for penetrating the-cigarette pack at said first position and for engaging said pack during movement of said pocket means from said first position to said third position;

(d) means, communicating with said penetrating means, for expanding the cigarette pack; and (e) means disposed between said first and third positions for cutting off one of said end panels.

16. Apparatus as in claim 15 wherein said expanding means includes an air supply and wherein said penetrating means comprises at least one needle means disposed in said pocket means and movable from said first position to said third position with said pocket means for admitting air to the space enclosing the cigarettes during movement of said pocket means from said second position to said third position.

17. Apparatus as in claim 15, wherein said cutting means is disposed between said second and third positions.

18. Apparatus as in claim 15 wherein said moving means and said expanding means comprises a drum means for rotatably mounting said pocket means, means for rotating said drum means to position said pocket means at said first, second and third positions and at a fourth position.

19. Apparatus as in claim 18, including means disposed at a said fourth position of said pocket means for imparting a force to the cigarette pack after the one end panel has been cut off to move the cigarette pack and the cigarettes contained therein in a given direction out of said pocket means and means for stopping the movement of the cigarette pack in said given direction such that the cigarettes contained in the pack continue moving in said given direction and separate from the pack.

20. Apparatus as in claim 19, wherein said means for imparting a force to the cigarette pack comprises an air supply, said pocket means having an air inlet connected to said air supply and means for admitting air to said air inlet when said pocket means is located at said fourth position.

21. Apparatus as in claim 19, wherein said means for stopping the movement of the cigarette pack comprises a transfer wheel means having a pocket for receiving the cigarette pack from said pocket means and means on said pocket for gripping the cigarette pack and retaining the same in said pocket.

22. Apparatus as in claim 15, including means for adjusting the length of said pocket means to accommodate cigarette packs of different lengths.

23. Apparatus as in claim 15, including plurality of pocket means mounted for rotational movement about an axis, each of said pocket means being movable between said first, second and third positions and a fourth position.

24. A method for opening a cigarette pack and removing the cigarettes therefrom, the pack having two side panels, front and back panels, and two end panels enclosing a space for the cigarettes comprising:

(a) receiving the pack and penetrating one end panel of the pack at a first position;

(b) moving the pack from the first position to a second position and then to a third position;

(c) expanding the pack by introducing air into the pack while moving the pack between the first position and the third position;

(d) cutting off the end panel opposite the penetrated end panel while moving the pack from the second position to the third position, thereby exposing a pack edge;

(e) moving the open pack to a fourth position;

(f) transferring the pack to a fifth position, in the direction of the open end; and (g) stopping the motion of the pack relative to the cigarettes at the fifth position, thereby separating the cigarettes from the pack.

25. A method as in claim 24 whereby the step of expanding the pack is accomplished by inserting a needle through an end of the pack and supplying air through the needle.

26. A method as in claim 24 whereby the pack is rotatably moved between the first and fourth positions.

27. A method as in claim 24 whereby the pack is transferred from the fourth to the fifth position by imparting an impulsive force to the cigarette pack after one end panel has been cut off, thereby moving the cigarette pack and the cigarettes contained therein in a given direction from the fourth to the fifth position.

28. A method as in claim 27 whereby the pack is moved from the fourth to fifth position by blowing air against the unopened end panel of the pack.

29. A method as in claim 24 whereby the stopping of the pack includes gripping the exposed pack edge at the fifth position.

* * * * *